United States Patent [19]

Hernandez

[11] 4,060,952

[45] Dec. 6, 1977

[54] BRICK

[76] Inventor: Gerardo Lopez Hernandez, Apartado, Postal No. 55-089, Iztapalapa, Mexico, 13

[21] Appl. No.: 683,550

[22] Filed: May 5, 1976

[51] Int. Cl.[2] ..... E04C 1/10

[52] U.S. Cl. ..... 52/593; 46/25

[58] Field of Search ..... 46/25, 28; 52/589–595, 52/284, 286, 574

[56] References Cited

U.S. PATENT DOCUMENTS

| | | | |
|---|---|---|---|
| 13,110 | 6/1855 | Till | 52/594 |
| 916,687 | 3/1909 | Everett et al. | 52/591 |
| 1,457,437 | 6/1923 | Kelly et al. | 52/592 |
| 3,299,599 | 1/1967 | Zachar | 52/595 |

FOREIGN PATENT DOCUMENTS

| | | | |
|---|---|---|---|
| 537,857 | 3/1922 | France | 52/594 |
| 547,633 | 9/1922 | France | 52/591 |
| 466,632 | 3/1914 | France | 52/286 |
| 425,869 | 4/1911 | France | 52/594 |
| 185,074 | 10/1936 | Switzerland | 52/594 |
| 142,824 | 8/1921 | United Kingdom | 52/594 |
| 223,820 of | 1824 | United Kingdom | 52/286 |
| 625,076 | 6/1949 | United Kingdom | 46/25 |

*Primary Examiner*—James L. Ridgill, Jr.

[57] ABSTRACT

This invention refers to a brick that may be used with other bricks having similar dimensions. While the normally exposed sides of the brick are flat, one end of the brick terminates in an angular truncate extension with the opposite end of the brick having a similarly shaped concave recess. The top of the brick has a conical shaped extension on one end and a conical recess on the other end thereof. The bottom of the brick also has a conical shaped extension on one end and a conical shaped recess on the opposite end as previously described for the top. A shoulder extends upward on one side above the top of the brick and downward on the diagonally opposing side below the bottom of the brick. The opposite side on both the top and bottom of the brick has a recess for receiving the shoulder. Holes extend through the brick from top to bottom to receive reinforcing bars therethrough.

1 Claim, 4 Drawing Figures

BRICK

BACKGROUND OF THE INVENTION

This invention relates to a new and useful improvement in structural building units and, more particularly, to such units in the form of bricks, building blocks, or the like used in building construction to build walls.

BRIEF DESCRIPTION OF THE PRIOR ART

Prior to the present invention, many different types of bricks or building blocks have been proposed and used in the building industry. A typical such building block can be seen in Torricelli (U.S. Pat. No. 3,116,570) which shows upward extensions and recesses in the bottom of the block. However, Torricelli does not show a forward extension on one end, and a recess on the other end to insure that the brick is properly aligned. Also, the extensions and recesses can be seen from the side of the brick as shown in FIG. 5.

Kniefel (U.S. Pat. No. 3,791,090) shows another type of brick using dovetail extensions to hold the brick into position. The manufacturing of a brick with dovetail extensions or connections is extremely impractical with the extensions having a tendency to break during shipment.

Zagray (U.S. Pat. No. 3,534,518) shows another type of building block that has a very complicated structure with the network of bonding mortar being shown in FIG. 19.

While the above given references are only typical of many types of patents that currently exist for building blocks, Applicant is unaware of any prior art showing a building block or brick that would anticipate the simplicity and utility of his invention.

SUMMARY OF THE INVENTION

Therefore, it is an object of the present invention to provide a brick that is simple in structure and manufacture, as well as easy to use. The present brick does not require mortar, however, mortar may be used if desirable for better sealing purposes. Applicant intends to primarily use the brick in more temperate climates wherein plaster on the inside of the brick wall would provide the necessary sealing. Reinforcing rods extending through the holes in the brick maintain the brick in position. The overlap provided by the forward extension of one end of the brick and recess of the other end of the brick, as well as the shoulders and recesses on the sides of the top and the bottom of the brick insure a snug fit between various bricks. The cone shaped extensions and recesses make sure that each brick is properly located in its correct position. Due to the position of the cones and recesses in the top and bottom of the brick, each layer of bricks would overlap the joints of the prior layer as in conventional brick laying techniques. Still the holes extending through the brick will be in proper alignment for reinforcing rods therethrough. The overlap of the shoulders and recesses on each side of the top and the bottom of the brick helps to provide a good seal against outside elements.

BRIEF DESCRIPTION OF THE PREFERRED EMBODIMENT

Figure 1:
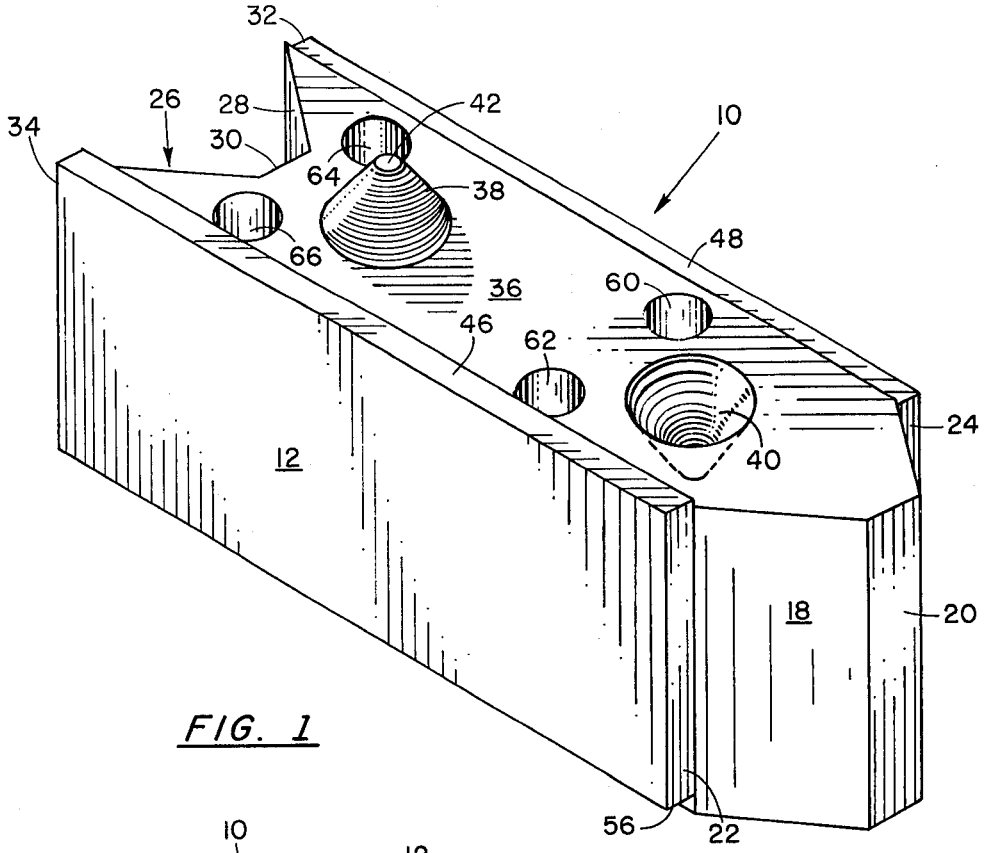
FIG. 1 is a perspective view of a brick comprising the present invention.
Figure 2:
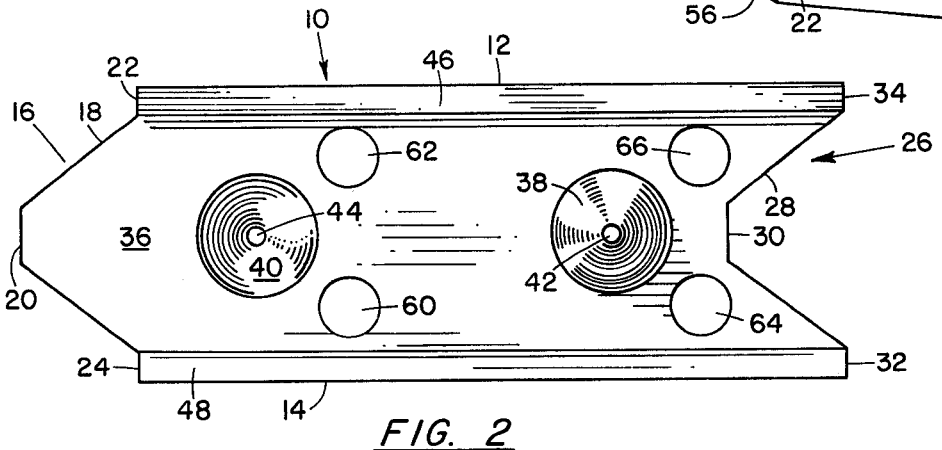
FIG. 2 is a top view of FIG. 1.
Figure 3:
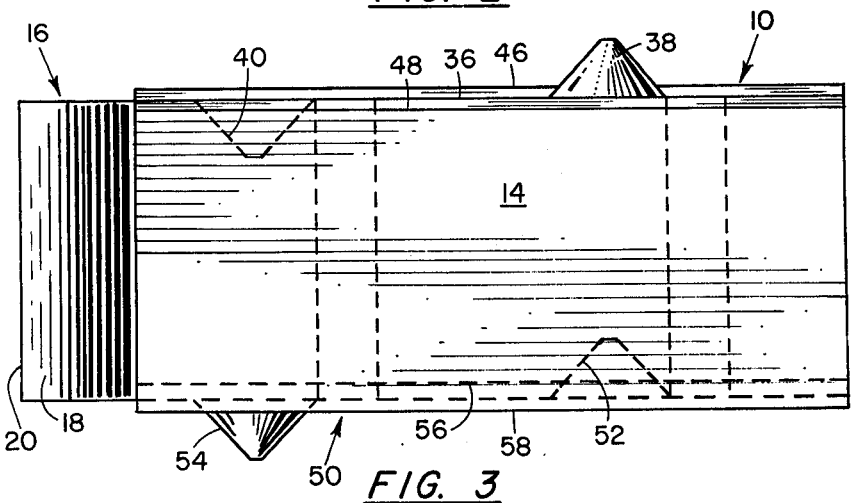
FIG. 3 is a side view of FIG. 1.
Figure 4:
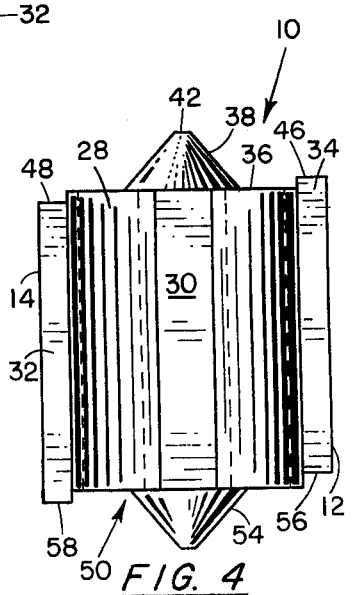
FIG. 4 is an end view of FIG. 1.

Referring now to the figures in combination, there is shown a brick represented generally by the reference numeral 10. The sides 12 and 14 of the brick are approximately the same size as most building bricks used in the building industry with the height being approximately 2 ½ inches and the length being approximately 9 inches. The sides 12 and 14 are flat, the same as in conventional bricks. The forward end of the brick 16 has a truncated angular extension 18 that terminates in a flat surface 20. The base of the truncated angular extension 18 terminates against vertical shoulders 22 and 24.

On the rearward end 26 there is an angular concave surface 28 that terminates in a flat vertical surface 30. The angular concave surface 28 and the flat vertical surface 30 are designed to receive the truncated angular extension 18 of other identical bricks (not shown). Also, the outermost portion of the angular concave surface 28 terminates against vertical shoulders 32 and 34. These vertical shoulders 32 and 34 fit flush against vertical shoulders 22 and 24 of other bricks.

The top 36 of the brick has a cone extension 38 on one end thereof and a cone recess on the opposite end thereof. The cone extension 38 has a flat upper surface 42 and the cone recess 40 has a flat lower surface 44. The cone extension 38 is positioned the same distance from its respective end of brick 10 as cone recess 40 is positioned from its respective end of brick 10. Side 12 of brick 10 extends above the top 36 to form a shoulder 46 extending thereabove. However, side 14 does not extend to the same level as top 36, thereby forming a recess 48 that has approximately the same dimensions as shoulder 46.

Referring now to the bottom 50 of the brick 10 it is substantially the mirror image of the top 36. Immediately below the cone extension 38 on the top 36 is located a cone recess 52 of identical size and configuration. Likewise, immediately below the cone recess of top 36 is located cone extension 54 of identical size and configuration. Also, on side 12 that has extension 46 above the top 36, there is located a recess 56 in the bottom 50. The recess 56 is substantially identical in dimensions to the shoulder 46. On side 14 immediately below recess 48 that extends below top 36, is located a downward extension 58 which extends below bottom 50. Again, the downward extension 58 is substantially identical in dimensions to the recess 48.

Extending through the brick 10 from top 36 to bottom 50 is a pair of holes 60 and 62 that are positioned equal distance from each respective side 12 and 14 of the brick 10. The holes 60 and 62 are located in a plane that is parallel to a second plane containing shoulders 22 and 24. On the opposite end of brick 10 is located another pair of holes 64 and 66 that are located the same distances from their respective sides 12 and 14 as the previously mentioned holes 60 and 62. Also, holes 64 and 66 are located in a plane that is parallel to a plane containing shoulders 32 and 34. The distance between the previously mentioned plane containing holes 64 and 66 and the plane containing shoulders 32 and 34 is the same as the distance between the plane containing holes 60 and 62 and the plane containing shoulders 22 and 24.

In building a structure from bricks manufactured in accordance with the brick 10, it is only necessary to use mortar below the lower-most level of the bricks. This is only necessary because of the irregular shape of the lowermost level, however, it should be understood that a brick may be used that has a flat lower surface but otherwise having all of the particular features as shown in brick 10. Thereafter, each subsequent layer of brick is laid by placing the bricks over the joint of the immediately lower level of bricks. The truncated angular extension 18 will be inserted into the angular concave surface 28 that forms the end of the adjacent brick. Likewise, the cone extension 54 on the bottom 50 will be inserted into the cone recess 40 of a lower brick while at the same time the cone recess 52 receives the cone extension 38 of a lower brick. Similarly, a downward extension 58 below the bottom 50 will fit into the recess 48 on lower bricks and the recess 56 will receive shoulders 56 of lower bricks.

By building a structure using bricks similar to brick 10, it is possible to lay an entire wall and never use mortar except below the lowermost level of bricks. All that is necessary is that the bricks be properly placed in position as previously described. After construction of the wall, reinforcing rods may be inserted through holes 60, 62, 64, and 66. If the bricks have been properly layed, holes 60 and 64 will be in line on an adjacent layers of brick. Likewise, holes 62 and 66 will be in alignment on adjacent layers of brick. By simply anchoring the reinforcing rods at the top of the wall, the wall is now securely tied together. To keep insects and bugs from coming between any minute cracks that may exist between various bricks, plaster is used to plaster the entire inside wall formed by the bricks.

I claim:

1. A brick having an oblong configuration, said brick comprising:

a pair of flat parallel surfaces;

a truncated angular extension on one end of said brick between said pair of flat parallel surfaces;

an angular recess on the end opposite said truncated angular extension of said brick between said pair of flat parallel surfaces, said angular recess being designed for receiving said truncated angular extension of an adjacent brick;

a top of said brick between said pair of flat parallel surfaces, a first end of said top having a generally conical extension thereabove and a second end having a generally conical recess therein;

a bottom of said brick between said pair of flat parallel surfaces, said bottom having a conical recess located immediately below said conical extension on the top of said brick and a conical extension in said bottom immediately below the conical recess in said top of said brick, said conical extensions and conical recesses being designed to fit conical extensions and recesses of adjacent bricks;

holes extending from said top of said brick to said bottom thereof, said holes being designed for alignment with holes of adjacent bricks;

said truncated angular extension and said angular recess extending from said top to said bottom of said brick an upward extension of one of said pair of flat parallel surfaces above said top and a recess in the other of said pair of flat parallel surfaces below said top, said bottom having substantially identical recesses and extensions for mating with adjacent bricks; and abutting shoulder means between said pair of flat parallel surfaces and both said truncated angular extension and said angular recess.

* * * * *